United States Patent [19]

Harding et al.

[11] Patent Number: 5,038,370

[45] Date of Patent: Aug. 6, 1991

[54] DIRECTIONAL VARIABLE SMALL CROSS-SECTIONAL X-RAY OR GAMMA RAY BEAM GEENRATING DIAPHRAGM WITH ROTATING HELICAL SLITS

[75] Inventors: Geoffrey Harding, Hamburg, Fed. Rep. of Germany; Petrus Merkelbach, Eersel; Franciscus L. A. M. Thissen, Hapert, both of Netherlands

[73] Assignee: U.S. Philips Corporation, New York, N.Y.

[21] Appl. No.: 494,041

[22] Filed: Mar. 14, 1990

[30] Foreign Application Priority Data

Mar. 18, 1989 [DE] Fed. Rep. of Germany ..... 3908966

[51] Int. Cl.[5] ..... G21K 5/10

[52] U.S. Cl. ..... 378/146; 378/147

[58] Field of Search ..... 378/146, 87, 6, 901, 378/145, 147, 149, 7; 250/505.1, 515.1

[56] References Cited

U.S. PATENT DOCUMENTS

| | | | |
|---|---|---|---|
| 3,766,387 | 10/1973 | Heffan et al. | 378/58 |
| 3,832,564 | 8/1974 | Hall et al. | 378/148 |
| 3,894,234 | 7/1975 | Mauch et al. | 378/146 |
| 4,480,332 | 10/1984 | Strecker | 378/87 |
| 4,750,196 | 6/1988 | Harding | 378/87 |
| 4,769,829 | 9/1988 | Webb et al. | 378/146 |

FOREIGN PATENT DOCUMENTS

| | | |
|---|---|---|
| 0074021 | 3/1983 | European Pat. Off. . |
| 0194743 | 5/1989 | European Pat. Off. . |
| 0194743 | 10/1989 | Fed. Rep. of Germany . |

*Primary Examiner*—Edward P. Westin
*Assistant Examiner*—Kim-Kwok Chu
*Attorney, Agent, or Firm*—William Squire

[57] ABSTRACT

The invention relates to an arrangement for generating an X-ray or gamma beam with small cross-section and variable direction, having an X-ray or gamma emitter, from the focus of which a bundle of rays emerges, and a diaphragm arrangement, which cuts out a beam from the bundle of rays and comprises a hollow-cylindrical first diaphragm body which is rotatable about its axis of symmetry and has two mutually offset helical slits on the circumference. In this arrangement, an X-ray beam with at least approximately square cross-section is cut out on a relatively long hollow-cylindrical body with small diameter by the slits winding around the diaphragm body in at least one turn each and being shaped in such a way that at least one straight line runs through the slits towards the focus, the position of which line can be varied by turning the diaphragm body.

20 Claims, 1 Drawing Sheet

Fig.1
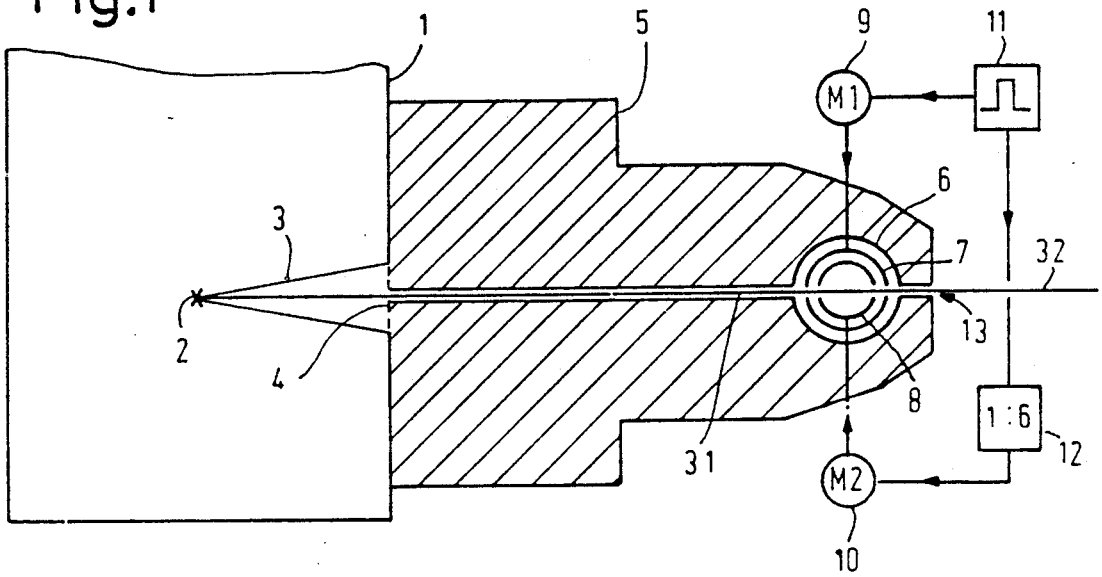
Fig. 2
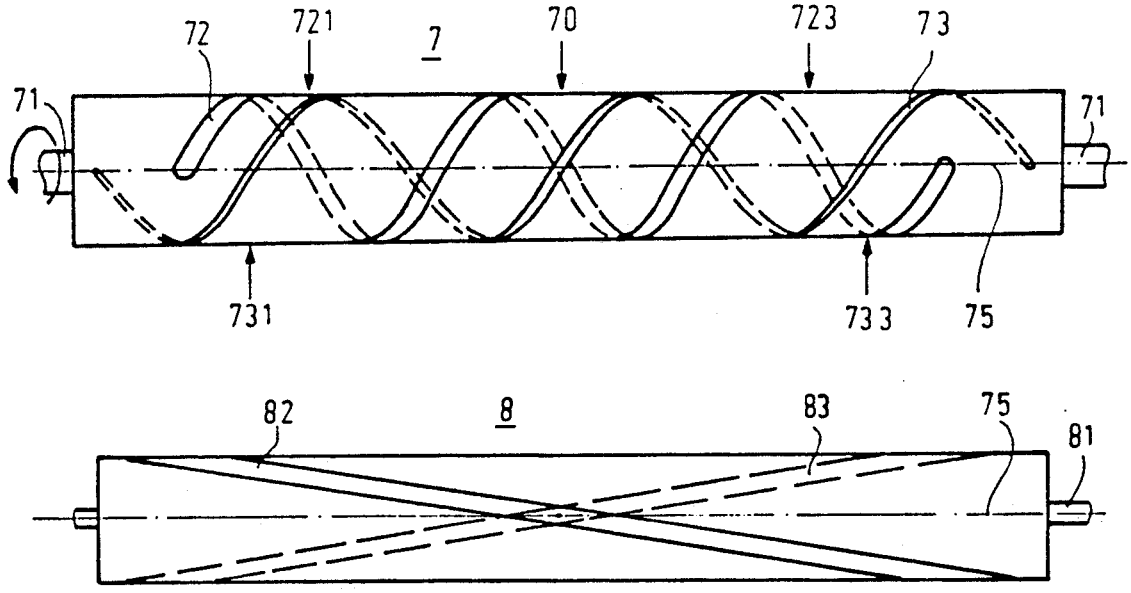
Fig.3

DIRECTIONAL VARIABLE SMALL CROSS-SECTIONAL X-RAY OR GAMMA RAY BEAM GEENRATING DIAPHRAGM WITH ROTATING HELICAL SLITS

BACKGROUND OF THE INVENTION

The invention relates to an arrangement for generating an X-ray or gamma beam with small cross-section and variable direction, having an X-ray or gamma emitter, from the focus of which a bundle of rays emerges, and a diaphragm arrangement, which cuts out a beam from the bundle of rays and comprises a rotatable hollow-cylindrical first diaphragm body having two mutually offset helical slits on the circumference.

Of interest is commonly owned copending application entitled "Device for Forming an X-ray or Gamma Beam of Small Cross-Section and Variable Direction" Ser. No. 400,188 filed Aug. 29,1989 in the name of G. Harding.

Arrangements of this type are essentially known from European laid-open patent application 74,021 for medical applications and from German Offenlegungsschrift 3,443,095 corresponding to U.S. Pat. No. 4,750,196 for industrial applications. The diaphragm body of a radiation-absorbing material has in this case the form of a hollow cylinder which is provided on its circumference with two mutually offset helically encircling slits. If a bundle of parallel rays falls onto such a diaphragm body perpendicularly to its cylinder axis, there is always a point at which an X-ray beam passes through the two slits. If the diaphragm body is turned, this point shifts along the axis, so that a periodically moved X-ray beam emerges behind the diaphragm body. This periodically moved X-ray beam can be used for medical or industrial examinations.

An X-ray beam with trapezoidal cross-section is defined by the two slits in the diaphragm body. What is desired, however, is a square or a circular cross-section, producing a directionally independent spatial resolution. With the same width of the two slits, the approximation to a square cross-sectional shape is all the better the larger the angle by which the two slits intersect each other. A larger angle of intersection could be achieved by using a diaphragm body with large diameter and small axial length. For many applications, however, a relatively large angle of deflection of the X-ray beam is necessary, which necessitates a corresponding axial length of the diaphragm body; a large diameter is undesirable in many applications due to the associated unit volume.

SUMMARY OF THE INVENTION

The object of the present invention is to design an arrangement of the type mentioned at the beginning in such a way that a favorable beam cross-section is achieved even in the case of a diaphragm body with small diameter and relatively large axial length.

This object is achieved according to the invention by the fact that the slits wind around the diaphragm body in at least one turn each and are shaped in such a way that at least one straight line runs through the slits towards the focus, the position of which line can be varied by turning the diaphragm body.

Thus, while in the prior art the two slits extend over an angle at circumference of 180° or have only half a turn, the slits in the invention extend over an angle at circumference of at least 360° or they have at least one turn (one turn corresponds to an angle at circumference of 360°.) The projection of the slits onto the axis of rotation or symmetry of the hollow-cylindrical diaphragm bodies therefore forms a considerably larger angle with the axis concerned, so that the X-ray beam cut out with a given slit width has considerably smaller dimensions in the direction of the said axis.

With the arrangement according to the invention, as many X-ray beams are generated as there are straight lines which pass through the slits and impinge on the focus. In many applications, however, for example those in which the scattered radiation produced by the X-ray beam is to be measured, one wishes to work just with a single X-ray beam. In a development of the invention it is therefore envisaged that a second diaphragm body which only ever allows through a primary beam is arranged in the bundle of rays, and that the second diaphragm body is arranged and designed in such a way that the primary beam always coincides with one of the straight lines.

In a preferred development, it is envisaged that the second diaphragm body has the form of a hollow cylinder, the axis of which lies in the plane containing the axis of symmetry and the focus and the cross-section of which is circular or semicircular and that the second diaphragm body is provided with one slit if of semicircular cross-section or with two helical slits mutually offset by 180° on the circumference if of circular cross-section. If in this case the first diaphragm body is driven faster by a factor of 2n (n is an integer) than the second, an X-ray beam which moves periodically can be cut out.

If the diaphragm arrangement is to form a spatially compact unit together with the X-ray or gamma emitter, the diameter of the diaphragm body is no longer negligible in comparison with its distance from the focus, so that an X-ray beam with larger axial distance emerges from the center of the diaphragm body than the beam which enters it. In order to satisfy these geometrical conditions, a further development of the invention envisages that the slits of the first diaphragm body have pitches differing from each other. In that case, the X-ray beams can only ever enter through one slit and emerge through the other slit. In a further development it is envisaged in this case that, of the slits in the first diaphragm body, the one with the greater pitch is narrower than the other one and that on the side of the first diaphragm body facing away from the focus a slit diaphragm is provided, the slit-shaped aperture of which lies in the plane formed by the focus and the axis of symmetry of the first diaphragm body. In this configuration, the dimension of the X-ray beam in the direction of the axis of symmetry is determined by the narrower of the two slits and its direction perpendicular thereto is determined by the aperture in the slit diaphragm.

BRIEF DESCRIPTION OF THE DRAWING

The invention is explained in more detail below with reference to the drawing, in which:

FIG. 1 shows an arrangement according to the invention,

FIG. 2 shows the first diaphragm body and

FIG. 3 shows the second diaphragm body.

DESCRIPTION OF THE PREFERRED EMBODIMENTS

A bundle of X-rays 3 emerges from the focus 2 situated in the housing 1 of an X-ray emitter and passes through the ray window 4 of the X-ray emitter. A diaphragm arrangement 5, which cuts out a ray fan 31 of a few millimeters in thickness from the bundle of X-rays 3 in a plane perpendicular to the plane of the drawing of FIG. 1, is connected to the housing 1. The diaphragm arrangement 5 has at its end facing away from the X-ray emitter 1 a cylindrical aperture 6, in which a first hollow-cylindrical diaphragm body 7 is arranged, which encloses a second diaphragm body 8, arranged concentrically to it. The common axis of symmetry and axis of rotation of the diaphragm bodies 7 and 8 is located in the plane of the ray fan 31, to be precise in such a way that the line joining the focus 2 to the center of the diaphragm body intersects the axis of symmetry at right angles.

The rotatably mounted diaphragm bodies 7 and 8 are driven by a drive arrangement in such a way that the first diaphragm body 7 rotates faster by a factor of 6 than the diaphragm body 8. For this purpose, the drive arrangement could include a single motor, which would be coupled via suitably designed transmissions to the diaphragm bodies 7 and 8. Instead of this, in FIG. 1—for the sake of simplicity—a drive device with two stepping motors 9 and 10 is shown, of which the stepping motor 9, coupled to the outer diaphragm body 7, is coupled directly to a clock pulse generator 11, while the stepping motor 10, acting on the second diaphragm body 8, is thus connected via a frequency divider 12, which reduces the stepping frequency at a ratio of 1:6. As a consequence, the diaphragm body 7 rotates at six times the speed of the inner diaphragm body.

As also explained in connection with FIGS. 2 and 3, a single X-ray beam 32 is cut out from the ray fan 31 by the diaphragm bodies 7 and 8, the dimensions of which beam in the vertical direction (perpendicular to the plane of the ray fan 31) are limited by a slit 13 which is only 0.5 mm wide and runs perpendicular to the plane of the drawing and the dimensions of which beam in the axial direction are determined by the design of the diaphragm body 7. If the diaphragm bodies rotate at constant speed, the X-ray beam 32 changes its point of impingement on a plane perpendicular to the plane of the drawing in accordance with a sawtooth-shaped time function.

FIG. 2 shows a lateral plan view of the first diaphragm body 7. The diaphragm body consists of a material of a thickness such that the X-radiation emerging from the focus 2 is absorbed virtually completely as a result, for example of a 1 mm thick tungsten alloy. The diaphragm body may have a length of, for example, 50 mm and a diameter of 12 mm. At least one of the hollow shafts 71 on its end faces is coupled to the drive device explained in further detailed with reference to FIG. 1.

Two mutually offset helical slits, which run around in the same encircling direction and have in each case a constant pitch are provided on the diaphragm body. Both slits have three turns or spirals each. The slit 73 has, however, a greater pitch (that is the ratio between the axial length of a turn and the circumference of the body 7) than the slit 72. The slit 73 has a width of 0.4 mm, while the slit 72 is considerably wider, for example 2 mm. The axial length of the slit 73 is slightly shorter than the length of the diaphragm body 7; if the slit were just as long, it would cut the diaphragm body into two divorced parts. Instead of three turns, the two slits may also have n turns (n=1 or 2 or else 4, 5, 6 etc.). In this case, the first diaphragm body would have to be rotated faster by a factor of 2n than the second diaphragm body 8. If the spirals in the diaphragm body 7 have the same encircling direction as the diaphragm body 8, the diaphragm bodies must be rotated in the same direction of rotation; if they have a difference encircling direction, a rotation in the opposite direction of rotation is necessary.

The two slits are arranged mutually offset in such a way that they are offset on the circumference by precisely 180° in the center of the diaphragm body, indicated by the arrow 70. In the position of the diaphragm body represented in FIG. 2, an X-ray beam can therefore pass through the slits 72 and 73 in the center of the diaphragm body perpendicular to the plane of the drawing—if the focus of the radiation source is located precisely in the center behind the diaphragm body. In this position of the diaphragm body there are two further points at which, on the side facing the focus, the slit 72 intersects the plane which is formed by the focus and the axis of symmetry or rotation 75. The axial position of these points is indicated by the arrows 721 and 723. Similarly, there are two points, which are indicated by the arrows 731 and 733, at which the slit 73 intersects the plane on the side facing away from the focus.

If the distance of the focus from the generating line facing it of the diaphragm body relates to the distance of the focus from the generating line facing away from it in the same way as the axial lengths of a turn of the slits 72 and 73 relate to each other, a further X-ray beam additionally passes through the slit 72 at 721 and through the slit 73 at 731. Similarly, an X-ray beam passes through the slits 72 and 73 at 723 and 733. These three X-ray beams define a plane which naturally coincides with the plane of the ray fan 31.

In this case, when the diaphragm body rotates, the three X-ray beams move to the left or to the right, depending on the direction of rotation, until the first beam reaches one end of the slit, after which a further beam appears at the other end.

It is clear from the above that the differences in the pitch of the slits or in the axial length of their turns are determined by the distance of the focus from the diaphragm body 7 and by the diameter of the diaphragm body. The smaller the ratio of these two values, the greater the difference in the lengths or pitches. If, on the other hand, the emitter is very far removed from the diaphragm body in comparison with the diameter, the lengths and the pitches of the two slits are virtually the same.

It also is evident from the above that the cross-section of an X-ray beam 32 emerging from the diaphragm arrangement 5 (cf. FIG. 1) is determined in the axial direction by the dimensions of the thinner slit and in the plane perpendicular to the ray fan 31 by the aperture of the slit diaphragm 13. It would also be possible to make the slit 72 just as narrow as the slit 73, so that the slit diaphragm 13 could even be dispensed with. However, with finite dimensions of the focus 2, this would result in an increase in the geometrical unsharpness of the X-ray beam and the arrangement would become more sensitive to production discrepancies in the position of the focus 2 with respect to the diaphragm body. Therefore, the arrangement with a wider slit 72 with smaller pitch and an additional slit diaphragm 13 is to be preferred.

As already mentioned, the diaphragm body 7 cuts out (at least) as many X-ray beams as the slits have turns. As a rule, however, only one X-ray beam is desired. Although this could be achieved if slits with only a single turn were provided, in this case the slits or their projection would intersect the plane of the ray fan at a considerably more acute angle, so that, with the same slit width, the axial dimensions would be considerably increased in an undesired way. In the case of the exemplary embodiment according to FIGS. 1-3, a different approach is therefore adopted: of the X-ray beams which could pass through the diaphragm body, only a single one is allowed through.

The second diaphragm body 8 (FIG. 3) serves this purpose. The second diaphragm body 8 is again a hollow cylinder, which may consist of the same material as the first diaphragm body and has at least one end face a shaft coupled ~~to~~ the drive device 9 . . . 12 (FIG. 1). Otherwise this diaphragm body corresponds to that according to European laid-open patent application 74,021, i.e. it is provided with two slits 82 and 83 mutually offset by 180° on the circumference, each of which extends over the same axial length and has the form of a helix. However, the two slits 82 and 83 have only half a turn, i.e. they extend over an arc of only 180° each on the circumference of the diaphragm body 8. The slits 82 and 83 are considerably wider than the narrow slit 73 on the first diaphragm body.

In a suitable position of the two diaphragm bodies with respect to each other, of the three X-ray beams which could pass through the first diaphragm body, two are absorbed, for example the two outer ones, and only the middle one is allowed through. If the second diaphragm body is rotated at a sixth of the speed of the first diaphragm body, this X-ray beam moves in both diaphragm bodies at the same speed, so that only this one X-ray beam is ever allowed through.

The number a of the turns of the slits 72, 73 in the first diaphragm body 7 which the X-ray beam passes through in the course of its axial movement does not necessarily have to be an integral number, and by the same token, the corresponding number b for the second diaphragm body 8 does not have to be precisely 0.5. However, for the ratio, the condition $a/b=2n$ must be satisfied, n being an integer (greater than 0). Only then is a periodic movement of the X-ray beam obtained at constant speed. If a is not an integral number and/or b is less than 0.5, during the course of the periodic movement there are intervals of greater or lesser length in which the X-ray beam is suppressed.

Instead of the diaphragm body represented in FIG. 3, other hollow-cylindrical diaphragm bodies co-rotating with the diaphragm body 7 may also be provided, as described in detail in German patent application P 38 29 688 which corresponds to the aforementioned copending application. For example, the diaphragm body may have a semicircular cross-section and be provided with only a single slit, which extends over the length of the diaphragm body and describes an arc of at least approximately 180°. Similarly, a hollow-cylindrical body of semicircular cross-section which is provided on its circumference with a plurality of apertures mutually offset in axial and circumferential directions may be used. However, in the case of the embodiment last mentioned, the X-ray beam jumps from one aperture to the other. The advantage of the embodiment represented in FIG. 3 over the one last-mentioned is also that this diaphragm body does not have any imbalance.

What is claimed is:

1. Apparatus for generating an X-ray or gamma beam with small cross-section and variable direction comprising an X-ray or gamma emitter, from the focus of which a bundle of rays emerges, and a diaphragm arrangement, which cuts out a beam from the bundle of rays and comprises a hollow-cylindrical first diaphragm body which is rotatable about its axis of symmetry and has two mutually offset helical slits on the circumference, said slits winding around the diaphragm body in at least one turn each and are shaped in such a way that at least one straight line runs through the slits towards the focus, the position of which line can be varied by rotation of the diaphragm body.

2. Apparatus according to claim 1 wherein each slit has an integral number of turns.

3. Apparatus according to claim 1 including a second diaphragm body which only allows there through a primary beam of the bundle of rays, and in that the second diaphragm body is arranged such that the primary beam always coincides with said at least one straight line.

4. Apparatus according to claim 3 wherein the second diaphragm body has the form of a hollow cylinder, the axis of which lies in the plane containing the axis of symmetry and the focus and the cross-section of which is circular and in that the second diaphragm body is provided with two helical slits mutually offset by 180° on the circumference.

5. Apparatus according to claim 4, wherein the slits on the circumference of the second diaphragm body describe in angle of 180°.

6. Apparatus according to claim 5 including a drive device which drives the first diaphragm body at 2n times the angular velocity as the second diaphragm body.

7. Apparatus according to claim 6 wherein the angle at the circumference which a slit on the first diaphragm body describes is greater by a factor of 2n than the angle at circumference described by a slit on the second diaphragm body where n is an integer.

8. Apparatus according to claim 4 wherein the two diaphragm bodies are arranged concentrically to each other and one encloses the other and in that the slits of the second diaphragm body are wider than at least one of the slits in the first diaphragm body.

9. Apparatus according to claim 8 wherein the first diaphragm body encloses the second diaphragm body.

10. Apparatus according to claim 1 wherein the slits of the diaphragm body have pitches differing from each other.

11. Apparatus according to claim 10 wherein of the slits in the diaphragm body, the one with the greater pitch is narrower than the other one.

12. Apparatus according to claim 1 including a slit diaphragm, the slit of which coincides with the axis of rotation of the diaphragm body and which determines the dimensions of the cut-out beam in the direction perpendicular to its longitudinal direction.

13. Apparatus according to claim 3 wherein the second diaphragm body has the form of a hollow cylinder, the axis of which lies in the plane containing the axis of symmetry and the focus and the cross-section of which is semicircular and in that the second diaphragm body is provided with one slit of semicircular cross-section.

14. Apparatus according to claim 13 wherein the slit on the circumference of the second diaphragm body describes an angle of 180°.

15. Apparatus according to claim 2 including a second diaphragm body which only allows there through a primary beam of the bundle of the rays, and in that the second diaphragm body is arranged such that the primary beam always coincides with said at least one straight line.

16. Apparatus according to claim 13 wherein the two diaphragm bodies are arranged concentrically to each other an one encloses the other and in that the slit of the second diaphragm body is wider than at least one of the slits in the first diaphragm body.

17. Apparatus according to claim 16 wherein the first diaphragm body encloses the second diaphragm body.

18. Apparatus according to claim 17 wherein the slits of the first mentioned diaphragm body have pitches differing from each other.

19. Apparatus according to claim 18 wherein of the slits in the first diaphragm body, the one with the greater pitch is narrower than the other one.

20. Apparatus according to claim 19 including a slit diaphragm the slit of which coincides with the axis of rotation of the first diaphragm body and which determines the dimensions of the cut-out beam in the direction perpendicular to its longitudinal direction.

* * * * *